US006089389A

United States Patent [19]

Sharon et al.

[11] Patent Number: 6,089,389

[45] Date of Patent: Jul. 18, 2000

[54] TWO-COMPARTMENT CONTAINER AND METHOD OF PREPARING THE SAME

[75] Inventors: Igal Sharon, Ceasaria; Michael Inbar, D.N. Shimkin, both of Israel

[73] Assignee: M.L.I.S. Projects Ltd., Tel Aviv, Israel

[21] Appl. No.: 08/811,007

[22] Filed: Mar. 4, 1997

Related U.S. Application Data

[63] Continuation-in-part of application No. 08/773,154, Dec. 26, 1996, abandoned.

[51] Int. Cl.[7] ..... A61J 9/00; A61J 11/04; B65D 23/04

[52] U.S. Cl. ..... 215/11.1; 215/6; 215/11.4; 215/400; 215/DIG. 8; 141/9; 426/117

[58] Field of Search ..... 215/6, 11.1, 11.4, 215/DIG. 8, 11.6; 426/117; 141/9

[56] References Cited

U.S. PATENT DOCUMENTS

| | | | |
|---|---|---|---|
| 2,371,774 | 3/1945 | Nosik . | |
| 2,533,806 | 12/1950 | Holzapfel . | |
| 2,781,141 | 2/1957 | Lucien . | |
| 2,793,776 | 5/1957 | Lipari | 215/11.1 X |
| 2,807,384 | 9/1957 | Lipari | 215/11.1 |
| 2,813,649 | 11/1957 | Lipari | 215/11 |
| 2,885,104 | 5/1959 | Greenspan | 215/11.1 X |
| 2,931,731 | 4/1960 | Pohjola | 215/11.1 X |
| 3,220,588 | 11/1965 | Lipari | 215/11 |
| 3,240,403 | 3/1966 | Modderno . | |
| 3,305,368 | 2/1967 | Bourelle . | |
| 3,310,190 | 3/1967 | Hurst | 215/11.6 |
| 3,314,563 | 4/1967 | Mounier | 215/6 |
| 3,373,864 | 3/1968 | Barton et al. | 215/11.6 X |
| 3,458,076 | 7/1969 | Babcock | 215/6 |
| 3,530,979 | 9/1970 | Merrill, Jr. et al. | 215/11.6 X |
| 3,720,522 | 3/1973 | Nakagami . | |
| 3,779,372 | 12/1973 | de Lloret . | |
| 3,856,138 | 12/1974 | Maekawa et al. | 206/221 |
| 3,983,994 | 10/1976 | Wyslotsky . | |
| 4,114,784 | 9/1978 | Hough et al. . | |
| 4,221,291 | 9/1980 | Hunt | 206/222 |
| 4,387,998 | 6/1983 | Szigeti | 366/130 |
| 4,410,085 | 10/1983 | Beneziat et al. | 206/217 |
| 4,711,359 | 12/1987 | White et al. | 215/11.1 |
| 4,776,972 | 10/1988 | Barrett | 252/90 |
| 4,779,722 | 10/1988 | Hall | 206/221 |
| 4,823,946 | 4/1989 | Stoeffler et al. | 206/221 |
| 5,088,627 | 2/1992 | Musel | 222/145 |

(List continued on next page.)

FOREIGN PATENT DOCUMENTS

| | | |
|---|---|---|
| 0 357 288 a1 | 3/1990 | European Pat. Off. . |
| 0 673 847 A1 | 9/1995 | European Pat. Off. . |
| 2615729 | 12/1988 | France . |
| 43 26 152 a1 | 2/1995 | Germany . |
| 679145 | 12/1991 | Switzerland . |

*Primary Examiner*—Sue A. Weaver
*Attorney, Agent, or Firm*—Pennie & Edmonds LLP

[57] ABSTRACT

A container holding two separate components, which are mixed prior to use is provided. The container comprises a housing defining a first compartment having a sealable opening and a neck portion between said first compartment and said opening. The container further comprises a displaceable member which is disposed within the housing which has a partition wall with an edge adapted for sealing engagement with the internal wall of the neck portion, thereby defining a second compartment sealed from the first compartment and being in flow communication with the opening. The displaceable member is axially displaceable between two positions along an axis extending through the neck portion. These two positions comprise a first position where the edge of the partition wall sealably engages the internal walls of the neck portion, and a second position where the edge of the partition wall and the internal walls of the neck portion are disengaged, permitting flow communication between the two compartments. The container with two components is prepared by first introducing a first component into the first compartment, placing the displacable member within the compartment and fitting it into said first position, introducing the second component into the second compartment and sealing the opening.

16 Claims, 6 Drawing Sheets

U.S. PATENT DOCUMENTS 5,275,298 1/1994 Holley, Jr. et al. ..... 215/11.4
5,277,303 1/1994 Goyet et al. ..... 206/221
5,330,048 7/1994 Haber et al. ..... 206/221
5,348,060 9/1994 Futagawa et al. ..... 215/DIG. 8 X
5,353,961 10/1994 Debush ..... 222/94
5,417,321 5/1995 Halm ..... 215/DIG. 8 X
5,419,445 5/1995 Kaesmeyer ..... 215/11.4 X
5,429,454 7/1995 Christine ..... 215/11.1
5,433,328 7/1995 Baron et al. ..... 215/11.4
5,447,226 9/1995 Laine ..... 206/219
5,456,929 10/1995 Mifune et al. ..... 206/219 X
5,474,209 12/1995 Vallet Mas et al. ..... 215/DIG. 8 X
5,514,394 5/1996 Lenahan ..... 206/219 X
5,529,794 6/1996 Fultz ..... 206/221 X
5,540,341 7/1996 Holey et al. ..... 215/11.5 X
5,542,528 8/1996 Lanfranconi et al. ..... 206/221
5,564,600 10/1996 Renault ..... 221/129
5,593,028 1/1997 Haber et al. ..... 215/DIG. 8 X
5,638,968 6/1997 Baron et al. ..... 215/11.4
5,685,422 11/1997 Kim ..... 206/222
5,692,644 12/1997 Gueret ..... 222/80

TWO-COMPARTMENT CONTAINER AND METHOD OF PREPARING THE SAME

CROSS REFERENCE TO RELATED APPLICATION

This patent application is a continuation-in-part of Ser. No. 08/773,154 of Dec. 26, 1996, now abandoned.

FIELD OF THE INVENTION

The present invention relates to containers and particularly such comprising two compartments, each one of which holds a separate component, to be mixed with one another prior to use,

BACKGROUND OF THE INVENTION

A variety of formulations for human use are stored a priori in the form of a dry particulate matter and are mixed with a liquid to form a liquid formulation shortly before use. This is the case, for example, with various nutritive formulas, including maternal milk substitute formulas, adult feeding formulas and a variety of drugs, e.g. antibiotics. The shelf life of such mixed liquid formulations is limited, and this dictates the need to prepare it into a liquid form only shortly before use. The limited shelf life of the liquid formulation is a result of a loss of activity of an active ingredient in the formula, accelerated oxidation once in solution, etc. When preparing a liquid formula from an a priori dry particulate formula, care should be taken to mix a correct amount of the two components, i.e. the dry particulate matter and the liquid, and in various applications it is also necessary to ensure that such mixing of component is performed under aseptic conditions, e.g. in the case of a drug, formulation to be administered parenterally.

Containers having separate compartments for storing two components, e.g. one being a dry particulate substance and the other being a liquid, both of which are mixed together prior to use, are known. Such two-compartment containers typically employ a breakable or displaceable partition between the two compartments. The partition is then either broken or displaced, as the case may be, to allow mixing.

GENERAL DESCRIPTION OF THE INVENTION

It is an object of the invention to provide a novel, two-compartment container for storing two components intended to be mixed prior to use, the first of such components being typically a liquid and the other a particulate solid, e.g. powdered substance.

In accordance with the present invention, there is provided a container comprising:

a housing defining a first compartment having a sealable opening and a neck portion between said first compartment and said opening;

a displaceable member disposed within said housing and having a partition wall with an edge adapted for a sealing engagement with internal walls of said neck portion, thereby defining a second compartment sealed from said first compartment and being in flow communication with said opening;

said displaceable member being axially displaceable between two positions along an axis extending through said neck portion, said two positions comprising a first position where the edge of said partition wall sealingly engages the internal walls of said neck portion, and a second position where said edge and said internal walls are disengaged permitting flow communication between the two compartments.

According to one preferred embodiment of the invention, said neck portion has a circular cross-section and accordingly said partition wall is circular. The edge of said partition wall is capable of tight seal contact with the internal walls of said neck portion. This may be achieved by a resilient portion forming an integral part of said edge or by a resilient member integrated into said edge, e.g. an O-ring fitted into an annular groove formed in said edge.

The partition wall of said displaceable member is typically dependent from a manipulable portion of said member, which is user-operable to allow displacement control, The dependency of said partition wall may, by one example, be by a central projecting stem, or by a plurality of stems, typically connected to the periphery of the partition wall. By further example, the dependency may be by peripheral walls, which are provided with openings allowing said flow communication in said second state. By further example, the dependency may be by means of non-peripheral wall sections, e.g. radially oriented.

In accordance with one preferred embodiment, the neck portion is formed as a constricted portion in an otherwise cylindrical container. The neck portion thus essentially divides the container into and defines two spaces, one proximal enclosed space adjacent to said opening and another, distal enclosed space remote from said opening, which in fact constitutes said first compartment. When said partition wall is in a sealing engagement with said neck portion, said partition wall together with said proximal enclosed space of the container constitutes said second compartment.

The container of the invention may be fashioned for a variety of uses. In accordance with one embodiment of the invention, said container serves as a baby's feeding bottle, in which case said first compartment contains a liquid, typically sterilized water, and said second compartment contains a powdered formula.

In accordance with another embodiment of the invention, said container is fashioned for storage of two components of a medicinal formulation, for example, said first compartment contains a liquid, e.g. a sterilized saline solution, and said second compartment contains a dry particulate drug formulation to be mixed with the liquid prior to use, e.g. an antibiotic drug formulation.

The relative size of said first compartment and said second compartment can be designed according to intended use. Typically, said first compartment will be the larger compartment and said second compartment will be smaller.

Said manipulable portion of the displaceable member may, in accordance with one embodiment of the invention, be adapted for screw engagement with the opening of the container. In accordance with such an embodiment, the axial displacement is achieved by the relative advance as a result of the helical displacement during rotation. In accordance with another embodiment of the invention, said displaceable member is displaced by axial pulling or pushing, such that said partition wall disengages said neck portion.

In accordance with an embodiment of the invention, said displaceable member is provided with a safety mechanism for avoiding unintentional axial displacement. By one example, such mechanism includes at least one radially projecting lug which is engaged in a partial circumferential groove in said container, and said displaceable member is rotational between the first angular position where said at least one lug is engaged in said groove and a second angular position wherein said lug is disengaged permitting axial displacement.

The container of the invention, as defined above, comprises two constituents, namely the housing and the displaceable member and having a sealable opening. The displaceable member may comprise an integral closure member sealing the opening, e.g. a breakable seal, which once broken allows to dispense the mixed formulation from the container. The container may also be provided with a closure assembly fitted at said opening. In accordance with one embodiment of the invention, said closure assembly comprises a removable stopper.

In accordance with another embodiment of the invention, the closure assembly is fashioned in a manner allowing a controlled release of the formulation from the container. The closure assembly in accordance with this embodiment is fashioned in a manner depending on the intended use. For example, in the case of a container for medicinal formulation, the closure assembly may for example be a rubber stopper, adapted for inserting a syringe needle for withdrawal of the medicinal formulation; in the case of a container intended for use as a baby's feeding bottle, the closure assembly may be a nipple. In addition, the closure assembly may be fashioned in a manner allowing dispensing of a fixed amount of the formulation each time of a plurality of occurrences. The closure assembly may also be fitted with an additional cover, e.g. aluminum foil covering a stopper or a cap covering the nipple, to secure the closure or allow the maintaining and/or sterility. In the case for a cap covering a nipple, the cap may be fitted in a manner to seal the nipple's opening so as to avoid spillage of the liquid formulation during mixing of the two components.

The container may be made for a one time use, i.e. disposable, e.g. housing made from thin plastic material. In addition, the container may be made to be recyclable, i.e. to be returned to the manufacturer after use for refilling. Furthermore, the container may also be made in a manner to allow refilling with the two components by the user.

The present invention further provides a process for preparing of a container holding two separate components of a formulation to mix with one another prior to use, the process comprising:

(a) providing a container having a housing defining a first compartment, an opening and having a neck portion between said first compartment and said opening;

(b) introducing a first component of said formulation into said first compartment;

(c) placing a displaceable member within said container, said member having a partition wall with an edge adapted for sealing engagement with internal walls of said neck portion, said displaceable member being axially displaceable along an axis extending through said neck portion between a first position where the edge of said partition wall engages the internal walls of said neck portion and a second position where said edge and said internal wall are disengaged providing flow communication between the two compartments; said displaceable member being placed in said container in said first position;

(d) introducing said second component into said second compartment; and (e) sealing said opening.

In accordance with one embodiment, the process is performed under septic conditions. In accordance with this embodiment, the process further comprises:

(f) placing a cover over said seal.

The invention still further provides a method for the preparation of a liquid formulation from a priori to individual components, the method comprising:

(a) providing a container as defined above with each of the two components being stored in one of the container's two compartments;

(b) axially displacing said displaceable member into said second compartment;

(c) agitating the container to mix the two components into said formulation.

One feature of preparing a liquid formulation using the container of the invention, particularly where the container is pre-filled in a manufacturing site, is that a correct ratio between the two components, e.g. between the powder and a liquid, may be observed, The invention will now be illustrated in some specific embodiments concerned with a baby's feeding bottle in accordance with the invention. It will be appreciated by the artisan that the same principle, mutatis mutandis, is also applicable in case of other containers of the invention, e.g. such intended for use for independent storing of two components or for a medicinal formulation which are mixed prior to use.

DETAILED DESCRIPTION OF A SPECIFIC EMBODIMENT

Figure 1:
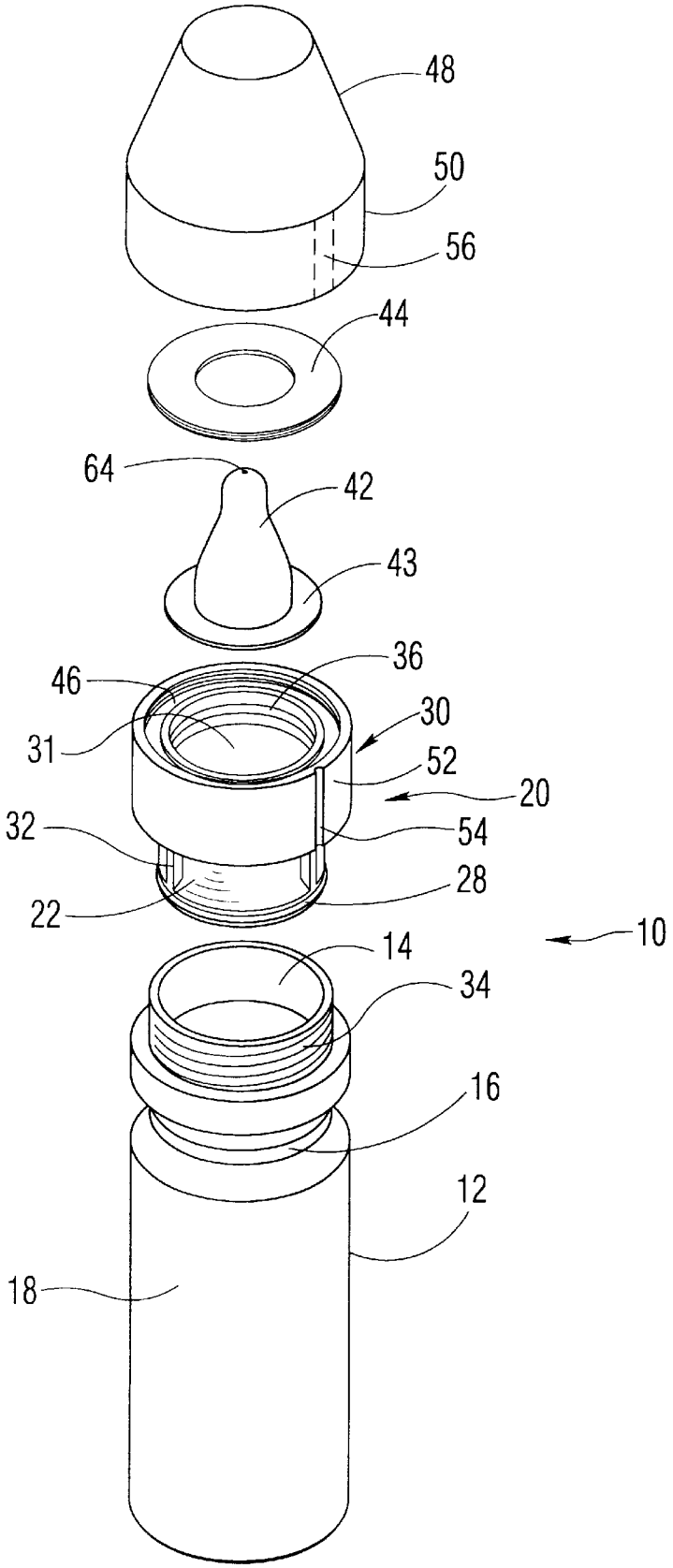
FIG. 1 is an exploded perspective view of a baby's feeding bottle in accordance the invention.
Figure 2:
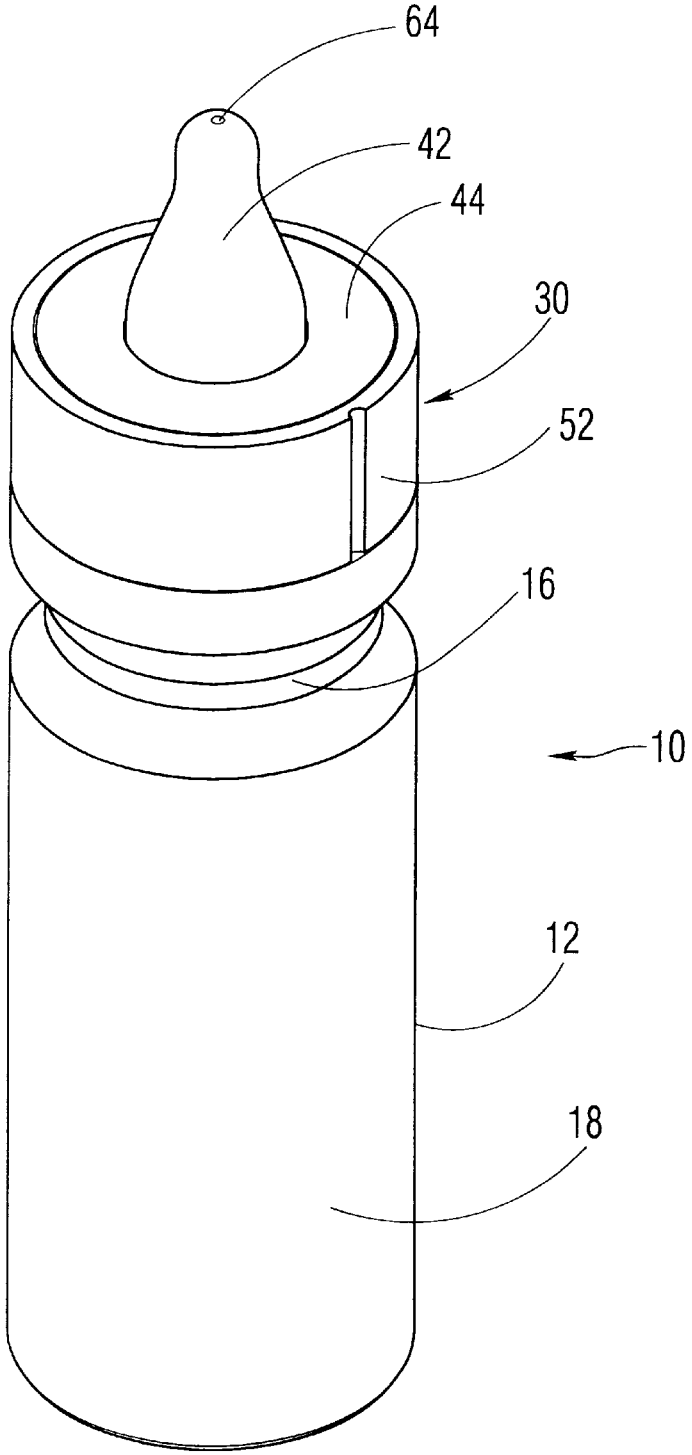
FIG. 2 a perspective view of a baby's feeding bottle in accordance with the invention with the cover removed.
Figure 3:
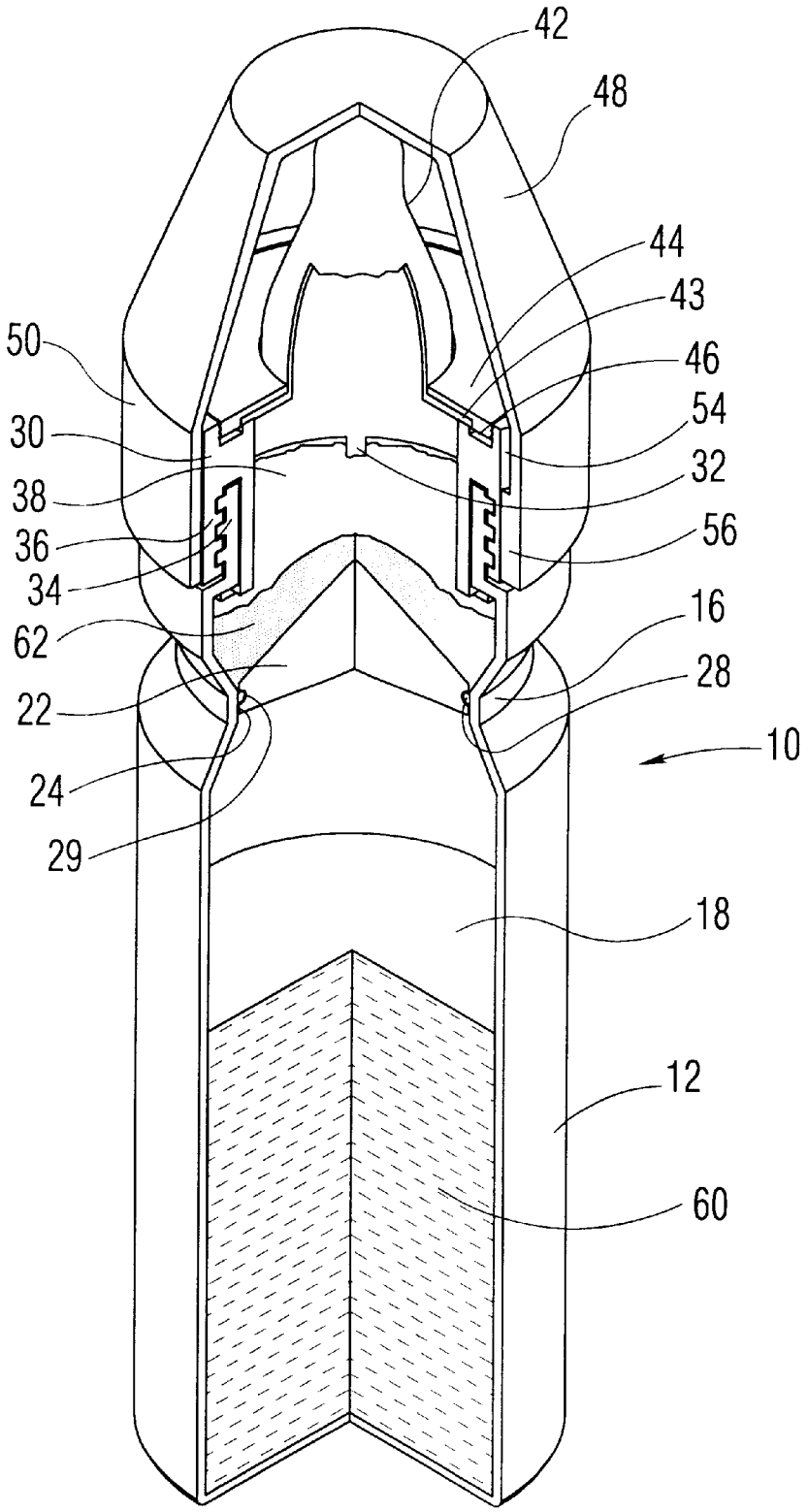
FIG. 3 is a perspective, partially cut-out view of a baby's feeding bottle in a storage position provided with a covering cap and holding two separately stored components of a liquid formulation.
Figure 4C:
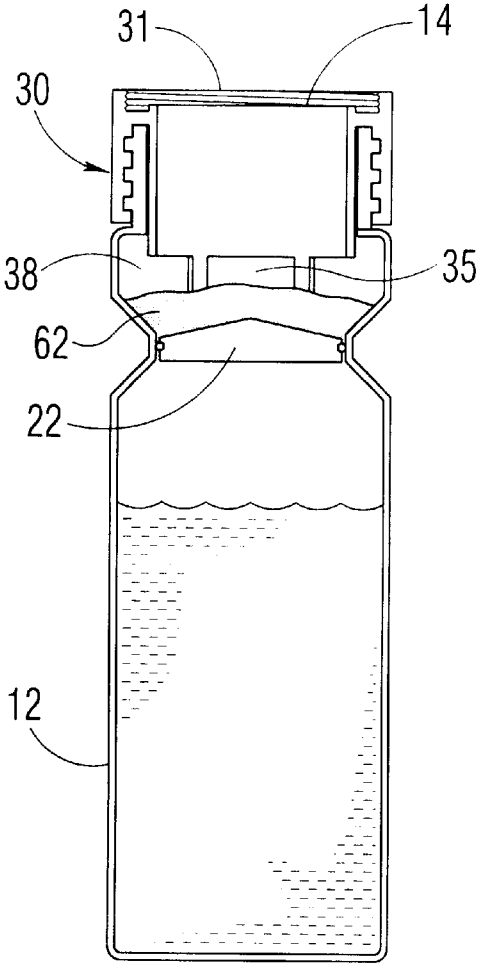
FIGS. 4A–4E show steps in filling a baby's feeding bottle of the invention with two separately stored components, a liquid component and a powdered formula, which are to be mixed prior to use.
Figure 4B:
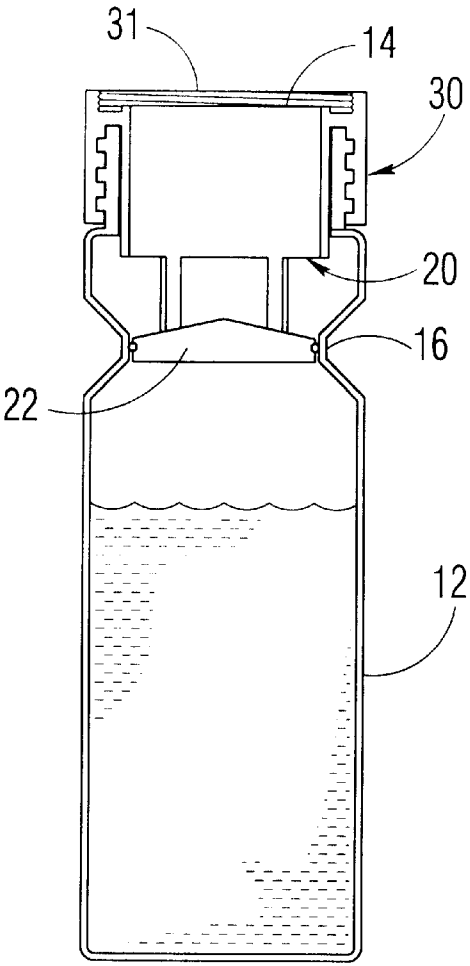
Figure 4A:
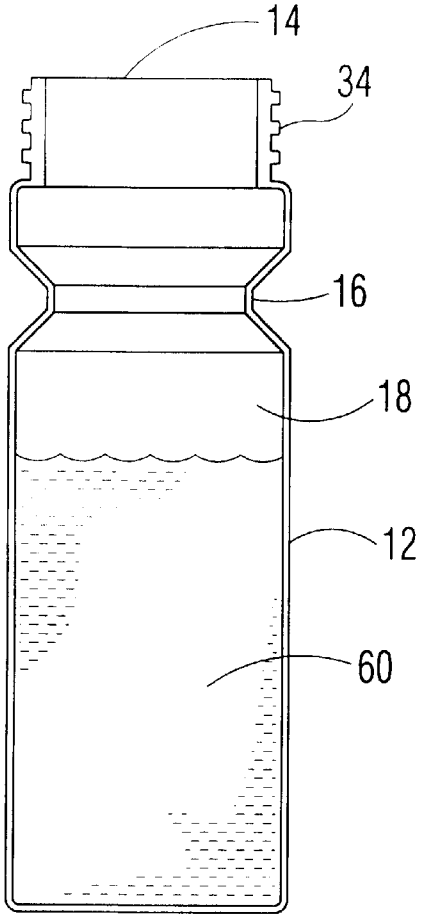
Figure 4E:
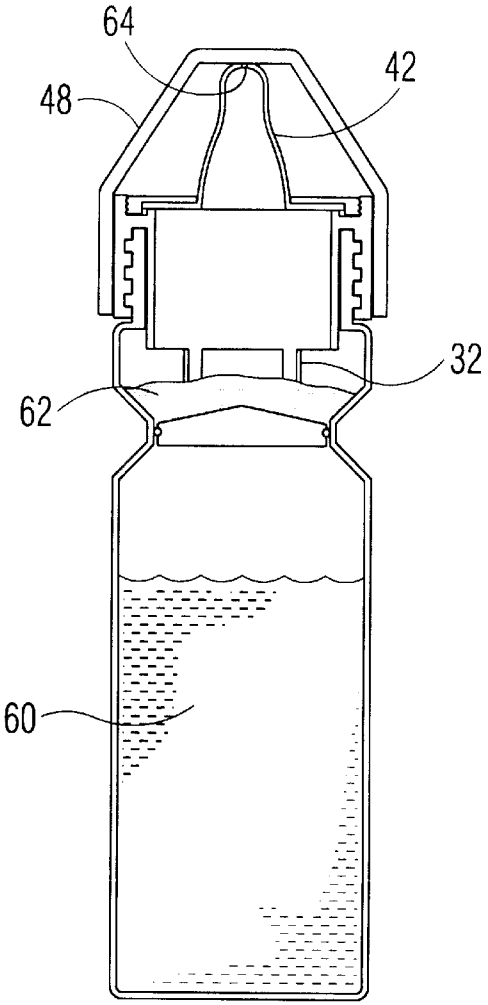
Figure 4D:
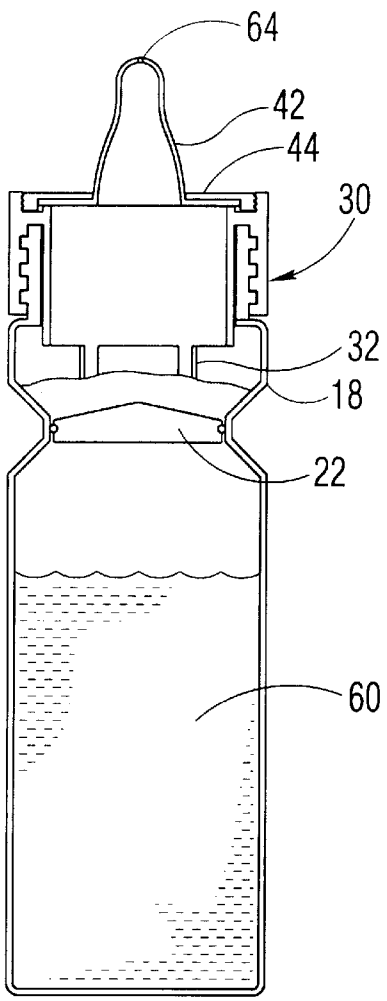

Reference is first being made to FIGS. 1–3 showing a baby's feeding bottle 10 in accordance with an embodiment of the invention. The baby's feeding bottle 10 has a general cylindrical housing 12 with an opening 14 and a constricted neck portion 16. The neck portion 16 defines a first compartment 18 beneath said neck portion. The container holds a displaceable member generally designated 20 which has a partition wall 22 with an edge 24 adapted for sealing engagement with internal walls of neck portion 16. The sealing engagement, in the specific embodiment, is ensured by means of a peripheral O-ring 28 fitted into an annular groove provided in edge 24. The partition wall 22 depends from a manipulable portion 30 by means of three downward projecting stems 32. Opening 14 is fitted with an external threading 34 for screw-engagement with internal threading 36 in displaceable member 20. In the specific embodiment shown herein, when the displaceable member is fully screwed onto opening 14, the partition wall comes to a sealing engagement with internal walls of neck portion 16, as can be seen particularly in FIG. 3. In this position of the partition wall, referred to above as "first state", the partition wall defines in fact two compartments, a first compartment 18 below said partition wall and a second compartment 38 between said partition wall and said opening. Upon rotation of the displaceable member in a counter-wise manner to that used for engagement, the partition wall is axially displaced towards the opening, disengaging the internal walls of neck portion 16, thus allowing communication between the two compartments.

The baby feeding bottle has nipple 24 with a flange 43 fitted into a recess 46 at a top end of the displaceable member 20 and fastened by means of a nipple retaining ring 44 which is snap-fitted into the recess 46 top end of the displaceable member 20 by means of a nipple retaining ring 44 which is snap fitted into a receptacle 46 at a top end of specimen member 20.

The baby's feeding bottle shown herein has further a cap 48 which has a cylindrical portion 50 which snugly engages the outer upper surface 52 of displaceable member 20, External face 52 has an axial groove 54 which cooperates with a radial inwardly facing projection 56 in cap 48. By virtue of this engagement, when cap 48 is rotated, this leads to rotation of displaceable member 20 and hence to axial displacement thereof.

In the specific embodiment shown, the first compartment 18 of the baby's feeding bottle holds a liquid 60, e.g. sterile water, and the second compartment 38 is filled with a powdered formula component 62.

The manner of production of a baby's feeding bottle of the kind shown in FIGS. 1–3, is shown stepwise in FIG. 4. As will be appreciated, the manufacture is preferably performed under aseptic conditions (illustrated in FIGS. 4A–4E by 58) using sterile components, to ensure sterility. In the first step of manufacture, as shown in FIG. 4A, liquid 60, typically sterile water, is introduced into housing 12. As a next step, shown in FIG. 4B, the displaceable member 20 is screw-fitted onto the opening 14 of the housing whereby the partition wall 22 comes into a sealing engagement with internal walls of neck portion 16. At a next step, shown in FIG. 4C, powdered formula 62 is introduced into the second compartment 38, followed by sealing the opening with nipple 42, by means of retaining ring 44 (FIG, 4D) and then placing cap 48 over said nipple (FIG. 4E). In this position cap 48 seals opening 64 in the nipple 42.

When preparing a baby's feeding bottle in accordance with the invention, in a manufacturing plant, the use of good quality water may be ensured, which may be important in some regions with poor quality of running water.

Figure 5B:
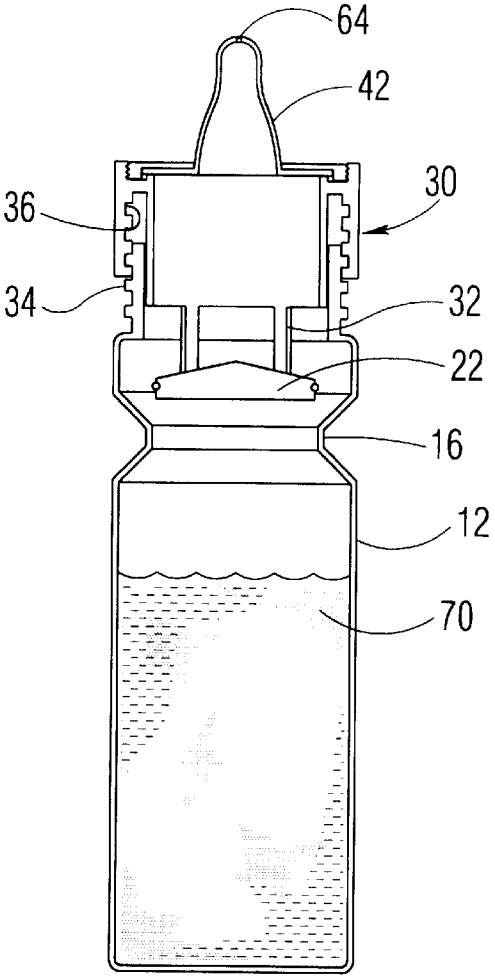
FIGS. 5A and 5B show steps in preparation of the baby's feeding bottle of FIG. 4A–4E for feeding.
Figure 5A:
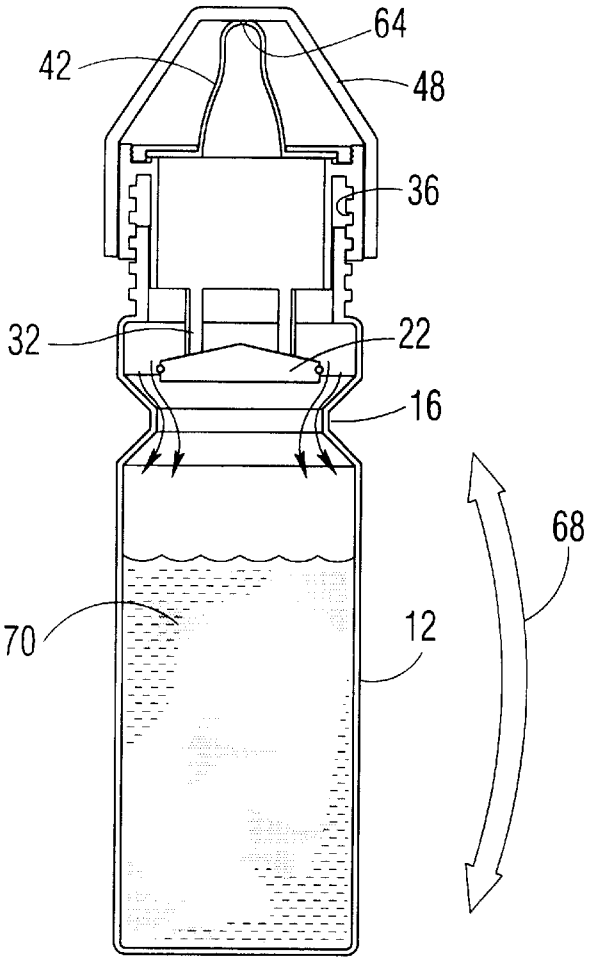

FIG. 5 shows the manner of preparation of the baby's feeding bottle for use. In a first step, (FIG. 5A) the displaceable member 12 is rotated whereby partition wall 22 is axially displaced whereby its edges disengage the inner walls of neck portion 16. In this position (said "second state"), the two compartments (the first and the second compartment) come into flow communication with one another. By agitating and rotation, represented by arrow 68, the dry formula 62 and liquid 18 are mixed with one another to yield liquid formula 70. By removal of cap 48, prior to use, the liquid formulation can be dispensed through opening 64 of nipple 42.

What is claimed is:

1. A baby's feeding bottle comprising:

a housing for separately storing at least two different components, the housing having a bottom wall, a dispensing opening opposite the bottom wall, at least one side wall of unitary structure and a neck portion positioned between the bottom wall and the dispensing opening, the neck portion defining a first bottom compartment between the bottom wall and the neck portion and a second top compartment between the neck portion and the dispensing opening;

a displaceable member disposed in the housing in a manner permitting flow-communication between the second compartment and the dispensing opening, the displaceable member having a recess at its top for receiving a flange of a nipple and further having a partition wall adapted for sealing engagement with the neck portion so as to seal the two compartments one from the other, the partition wall being dependent from a manipulable portion of the displaceable member by at least one stem, the displaceable member and housing adapted so that the interior of the displaceable member is in flow-communication with the interior of the compartment within which it is disposed at all times;

wherein the partition wall is axially displaceable between a first low position where the partition wall sealingly engages the neck portion, and a second upper position where the partition wall and the neck portion are disengaged permitting flow-communication between the two compartments.

2. A feeding bottle according to claim 1, wherein the partition wall depends from the manipulable portion by a plurality of stems.

3. A feeding bottle according to claim 1, wherein the partition wall depends from the manipulable portion by at least one stem connected to the periphery of the partition wall.

4. A feeding bottle according to claim 1, wherein the displaceable member and the opening have cooperating threads and the displaceable member is screw-engaged with the opening of the container, the axial displacement being achieved by rotation of the displaceable member with respect to the housing.

5. A feeding bottle according to claim 1, wherein an outer face of the manipulable portion has an axial groove engaging a projection of a cap such that rotation of the cap yields rotation of the displaceable member.

6. A feeding bottle according to claim 1, wherein the nipple is retained in a receptacle formed in the displaceable member by means of a nipple-retaining ring snap-fitted into the receptacle.

7. A feeding bottle according to claim 1, wherein the neck portion is of unitary structure such that it cannot be disconnected into multiple pieces.

8. A feeding bottle according to claim 7, wherein the housing is fabricated out of raw material as one continuous piece such that it is not assembled from two or more pieces.

9. A feeding bottle according to claim 8, wherein the neck portion is formed as a constricted portion in an otherwise substantially cylindrical housing.

10. A feeding bottle according to claim 8, wherein the displaceable member and the dispensing opening have cooperating threads and the displaceable member is screw-engaged with the opening of the container, the axial displacement being achieved by rotation of the manipulable portion with respect to the housing.

11. A bottle according to claim 10, wherein the manipulable portion is an annular ring which forms the opening of the displaceable member, the annular ring cooperating with and surrounding the dispensing opening.

12. A process for preparing a baby's feeding bottle for separately holding two components of a formulation to be mixed with one another within the bottle prior to use, the process comprising:

(a) providing a housing for storing at least two different components, the housing having a bottom wall, a dispensing opening opposite the bottom wall, at least one side wall of unitary structure and a neck portion positioned between the bottom wall and the dispensing opening, the neck portion defining a first bottom compartment between the bottom wall and the neck portion and a second top compartment between the neck portion and the opening;

(b) introducing the first component of the formulation into the housing;

(c) providing a displaceable member in the housing in a manner permitting flow-communication between the second compartment and the dispensing opening, the displaceable member having a recess at its top for receiving a flange of a nipple, a partition wall adapted for sealing engagement with the neck portion so as to seal the two compartments one from the other, an opening for receiving at least one of the components, a manipulable portion for controlling axial movement of the displaceable member, the partition wall being dependent from a manipulable portion of the displaceable member by a plurality of stems, the displaceable member and housing adapted so that the interior of the displaceable member is in flow-communication with the interior of at least one compartment at all times and the displaceable member may be axially displaced along an axis extending through the neck portion between a first position where the partition wall engages the neck portion and a second position where the partition wall and the neck portion are disengaged providing flow-communication between the two compartments;

(d) placing the displaceable member within the housing in the first position;

(e) introducing the second component into the housing; and (f) placing the nipple into the recess.

13. A process according to claim 12, further comprising the following additional step:

(g) snap-fitting a nipple-retaining ring into the recess.

14. A process according to claim 13, comprising providing the housing fabricated out of raw material as one continuous piece such that it is not assembled from two or more pieces .

15. A process according to claim 12, further providing sterile water as the first component and a powdered formulation as the second component.

16. A process according to claim 12, comprising providing the housing having the neck portion of unitary structure such that it cannot be disconnected into multiple pieces.

* * * * *